US007150251B2

(12) United States Patent
Watanabe et al.

(10) Patent No.: US 7,150,251 B2
(45) Date of Patent: Dec. 19, 2006

(54) VALVE TIMING CONTROL APPARATUS

(75) Inventors: Atsushi Watanabe, Mito (JP); Isao Hayase, Tsuchiura (JP); Seiji Suga, Kiyokawa (JP); Takanori Sawada, Atsugi (JP); Tomoya Tsukada, Ebina (JP)

(73) Assignee: Hitachi, Ltd., Tokyo (JP)

( * ) Notice: Subject to any disclaimer, the term of this patent is extended or adjusted under 35 U.S.C. 154(b) by 20 days.

(21) Appl. No.: 11/133,301

(22) Filed: May 20, 2005

(65) Prior Publication Data

US 2005/0257763 A1 Nov. 24, 2005

(30) Foreign Application Priority Data

May 20, 2004 (JP) ..... 2004-149924

(51) Int. Cl.
*F01L 1/34* (2006.01)

(52) U.S. Cl. ..... 123/90.17; 123/90.12; 123/90.16; 123/90.15; 123/90.31; 92/121; 92/122; 464/1; 464/2; 464/160

(58) Field of Classification Search ..... 123/90.17
See application file for complete search history.

(56) References Cited

U.S. PATENT DOCUMENTS 6,186,104 B1 * 2/2001 Torii et al. ..... 123/90.17

FOREIGN PATENT DOCUMENTS

JP 2001-317382 11/2001
JP 2002-168103 6/2002
JP 2002-235513 8/2002

* cited by examiner

*Primary Examiner*—Thomas Denion
*Assistant Examiner*—Kyle M. Riddle
(74) *Attorney, Agent, or Firm*—Antonelli, Terry, Stout and Kraus, LLP.

(57) ABSTRACT

The invention intends to improve a response by utilizing a rotational variable torque of a cam shaft. Communication paths respectively communicating an advance hydraulic chamber and a retard hydraulic chamber provided in a second rotary member and a hydraulic connecting passage are provided so as to be communicated, at a time when a control member intending to improve a response by moving a phase angle control slider in an axial direction or a rotational direction in correspondence to an operating state such as an advance, a retard or the like so as to intermittently communicate an advance chamber communication path and a retard chamber communication path with a hydraulic chamber connecting groove only in a section in which a cam shaft variable torque in an operating direction is applied, is controlled in a rotating region, and a relative rotation of a third rotary member and the second rotary member stops.

10 Claims, 7 Drawing Sheets

VALVE TIMING CONTROL APPARATUS

TECHNICAL FIELD

The present invention relates to a valve timing control apparatus variably controlling an opening and closing time of a supply and exhaust valve in an engine in correspondence to an operation state, and more particularly to a vane type variable valve timing control apparatus using a hydraulic pressure, and an opening and closing timing control of an intake or exhaust valve on the basis of the valve timing control apparatus.

BACKGROUND ART

In conventional, there has been a vane type variable valve timing control apparatus for variably controlling an opening and closing time of an intake or exhaust valve in an engine by variably controlling a rotational phase of a cam shaft driven by a crank shaft of the engine via a chain sprocket or the like, and an opening and closing timing control method using the same.

The vane type variable valve timing control apparatus is provided with a vane rotor integrally rotating with a cam shaft in an inner portion of a timing pulley, and an advance hydraulic chamber and a retard hydraulic chamber rotating the vane rotor to an advance side or a retard side. The vane rotor rotates to the advance side or the retard side by supplying and discharging the hydraulic pressure to the advance hydraulic chamber and the retard hydraulic chamber in correspondence to the engine operation state, and changes a phase of the opening and closing time of the intake or exhaust valve on the basis of a change of the rotational phase of the chain sprocket and the cam shaft generated thereby.

In this case, positive and negative rotational variable torques caused by a spring force of a valve spring or the like are applied to the cam shaft controlling the opening and closing time of the intake or exhaust valve. Accordingly, when the rotational variable torque is applied in the act of rotationally driving the vane rotor to the retard side or the advance side, the rotational variable torque becomes larger than the vane rotor driving hydraulic pressure, so that a phenomenon that the vane rotor is pressed back is generated. Therefore, there is a problem that a response of the opening and closing time control of the intake or exhaust valve is lowered.

Further, the oil pump used as a hydraulic pressure source is rotationally driven in synchronous with a crank shaft of the engine, and a discharge amount thereof is approximately in proportion to an engine rotational speed. Accordingly, there is generated a problem that it is impossible to secure a sufficient power for driving the vane rotor or a sufficient response in the case that the engine rotational speed is low, in comparison with the case that the engine rotational speed is high.

Accordingly, as described in JP-A-2002-235513, there are provided a switch means for selecting advance and retard directions, and a check valve operating on the basis of the positive and negative change of the variable torque. Therefore, it is possible to intend to improve the response by utilizing a hydraulic pressure generated in the variable torque in the advance direction at a time of the advance and a hydraulic pressure generated in the variable torque in the retard direction at a time of the retard, in addition to driving of the vane rotor on the basis of the normal supply and discharge of the hydraulic pressure with respect to the advance hydraulic chamber and the retard hydraulic chamber.

In JP-A-2001-317382, there is described a structure which is provided with an energizing means, and a control means for controlling a valve timing in addition to an energizing force of the energizing means.

In JP-A-2002-168103, there is described a structure which is provided with a hydraulic pressure supply and discharge means for relatively supplying and discharging a hydraulic pressure generated in a hydraulic pressure source with respect to an advance hydraulic chamber and a retard hydraulic chamber, by selectively communicating from the retard hydraulic chamber to the advance hydraulic chamber.

The technique described in the JP-A-2002-235513 showing the prior art mentioned above is of a type utilizing the hydraulic pressure generated in the variable torque in the advance direction at a time of the advance and the variable torque in the advance direction at a time of the retard time, by the switch means for selecting the advance and retard directions, and the check valve operating on the basis of the positive and negative change of the variable torque. However, since the check valve operating on the basis of the positive and negative change of the variable torque is operated only after the change of positive angle of the variable torque is generated, a time lag is necessarily generated in opening and closing the check valve. Accordingly, there is a problem that the variable torque in an opposite direction to a direction to be rotated is applied only for a short time.

BRIEF SUMMARY OF THE INVENTION

An object of the present invention is to make it possible to utilize a desired variable torque in a rotational direction in a specified or limited manner by specifying or limiting a variable torque utilizing range on the basis of an angle of rotation of a cam shaft, thereby achieving a response of a phase conversion in advance and retard directions.

In accordance with the present invention, there is provided a valve timing control apparatus comprising:

a first rotary member rotationally driven in synchronous with a crank shaft of an engine;

a second rotary member connected to a cam shaft so as to be rotationally driven;

an advance hydraulic chamber and a retard hydraulic chamber formed by utilizing the first rotary member and the second rotary member, and increasing or reducing a volumetric capacity by a relative rotational direction while working with a relative rotation of both the rotary members; and the valve timing control apparatus changing a rotational phase of the cam shaft by selectively supplying and discharging an oil from a hydraulic pressure supply and discharge means with respect to the advance hydraulic chamber and the retard hydraulic chamber so as to change an opening and closing timing of an intake valve or an exhaust valve, wherein a hole portion in an axial center portion of the second rotary member is provided with a third rotary member having a control member, a rotation control portion controlling a rotating range of the control member, and a hydraulic pressure connecting passage portion integrally rotating with the control member and provided in a circumferential surface opposing to an inner peripheral surface of the second rotary member, and a communication path communicating with each of the advance hydraulic chamber and the retard hydraulic chamber provided in the second rotary member is communicated with the hydraulic pressure connecting passage in the case that the rotating range of the control member is controlled and the relative rotation of third rotary member and the second rotary member stops. Further, there is provided an opening and closing timing control method using the valve timing control apparatus mentioned above.

There is provided a valve timing control apparatus having a position control means for moving the third rotary member in an axial direction within the hole portion, and controlling a position from an inhibiting state of the communication between the communicating path and the hydraulic pressure connecting passage to a communicating state, for example, a slider member.

In accordance with the present invention, there is provided an intake valve or opening and closing timing changing method by a valve timing control apparatus comprising:

a first rotary member rotationally driven in synchronous with a crank shaft of an engine;

a second rotary member connected to a cam shaft so as to be rotationally driven;

an advance hydraulic chamber and a retard hydraulic chamber formed by utilizing the first rotary member and the second rotary member, and increasing or reducing a volumetric capacity by a relative rotational direction while working with a relative rotation of both the rotary members; and the valve timing control apparatus changing a rotational phase of the cam shaft by selectively supplying and discharging an oil from a hydraulic pressure supply and discharge means with respect to the advance hydraulic chamber and the retard hydraulic chamber, wherein an operating force is generated at a phase angle near positive and negative maximum values of the variable torque while working with the variable torque of the cam shaft, and an opening and closing timing of the intake valve or the exhaust valve is changed by controlling the advance hydraulic chamber and the retard hydraulic chamber operated by the operating force and provided in the second rotary member from a communication inhibiting state to a communicating state.

In accordance with the present invention, it is possible to execute the phase conversion in the advance and retard directions with an improved response, at a timing before and after the variable torque of the cam shaft reaches the maximum value, that is, by utilizing the variable torque showing the maximum value.

As mentioned above, it is possible to achieve the type utilizing only the variable torque in the advance direction at a time of the advance operation and utilizing only the variable torque in the retard direction at a time of the retard operation, by arranging the hydraulic pressure supply and discharge means in which the communication path extending from the advance hydraulic chamber and the retard hydraulic chamber and the slider member corresponding to the position control member are communicated, and limiting the oil supply and discharge with respect to the advance hydraulic chamber and the retard hydraulic chamber. Accordingly, it is possible to intend to improve the response for controlling the phase of the cam shaft, and it is possible to control the phase of the cam shaft even in the state in which the engine rotational speed is low and a sufficient hydraulic pressure can not be supplied, such as an engine start time or the like.

As the present embodiment, there is provided a valve timing control apparatus comprising:

a housing integrally provided in a chain sprocket rotationally driven in synchronous with a crank shaft of an engine;

a vane rotor having a vane connected to a cam shaft so as to be rotationally driven and received in the housing;

an advance chamber and a retard chamber formed between the vane rotor and the vale so as to be sectioned by the vane;

the advance chamber and the retard chamber increasing or reducing a volumetric capacity by a relative rotational direction while working with a relative rotation of the housing and the vane rotor; and the valve timing control apparatus changing a rotational phase of the cam shaft by selectively supplying and discharging an oil with respect to the advance chamber and the retard chamber so as to change an opening and closing timing of an intake valve or an exhaust valve, wherein a hole portion of an axial center portion of the vane rotor is provided with a phase angle control slider moved in an axial direction by a drive apparatus, having a groove portion formed in an outer peripheral direction, having a space portion in which an angle sectioned by a slider portion vane rotor is limited in a slider portion advance hydraulic chamber and a slider portion retard hydraulic chamber, in an end portion, and integrally rotating with the slider portion vane rotor, the slider portion vane rotor rotates by supplying and discharging the oil with respect to the slider portion advance hydraulic chamber and the slider portion retard hydraulic chamber respectively communicating with the advance chamber and the retard chamber, the rotation is limited by a limitation of the angle of the space portion at a timing near a timing when the variable torque of the cam shaft is a maximum value, the rotation of the phase angle control slider is limited in accordance with the rotation limitation of the slide portion vane rotor, and the groove portion is communicated with an oil passage communicating with each of the advance chamber and the retard chamber in accordance with the movement in the axial direction by the phase slider so as to transfer the oil from the advance chamber to the retard chamber or transfer the oil in the retard chamber to the advance chamber, thereby assisting a motion for changing the vane rotor to an advance side or a phase lap side.

In order to achieve the object mentioned above, the structure is made such that only the value in the vicinity of the maximum value of the cam shaft variable torque is utilized for the advance and retard motions. The structure is made such that the slider member intermittently communicating the communication path extending from the advance hydraulic chamber and the retard hydraulic chamber is provided in the axial center portion of the vane rotor, and the utilized variable torque can be selected by moving the slider member in an axial direction or a rotational direction in correspondence to the variable torque in the advance and retard directions.

The grooves intermittently communicating the communication path extending from the advance hydraulic chamber and the retard hydraulic chamber are formed on an outer peripheral surface of the slider member at a uniform interval in correspondence to the engine type. The slider member is at a standstill with respect to the cam shaft, and the communication path extending from the advance hydraulic chamber and the retard hydraulic chamber and the groove formed in the slider member are communicated with the section to which only the variable torque in the advance direction is applied, at a time of the advance operation. Accordingly, the oil is pressure fed to the advance hydraulic chamber from the retard hydraulic chamber via the communication path and the groove formed in the slider member, on the basis of the variable torque in the advance direction applied to the vane rotor at a time of the advance operation, thereby forming a force rotating in the advance direction.

The same matter as the advance operation time is applied to the phase lap operation time, and the slider member is maintained at a position where the communication path and the groove formed in the slider member are not communicated, at a time of maintaining the phase angle.

Other objects, features and advantages of the invention will become apparent from the following description of the embodiments of the invention taken in conjunction with the accompanying drawings.

DETAIL DESCRIPTION OF THE INVENTION

Embodiment 1

Figure 1:
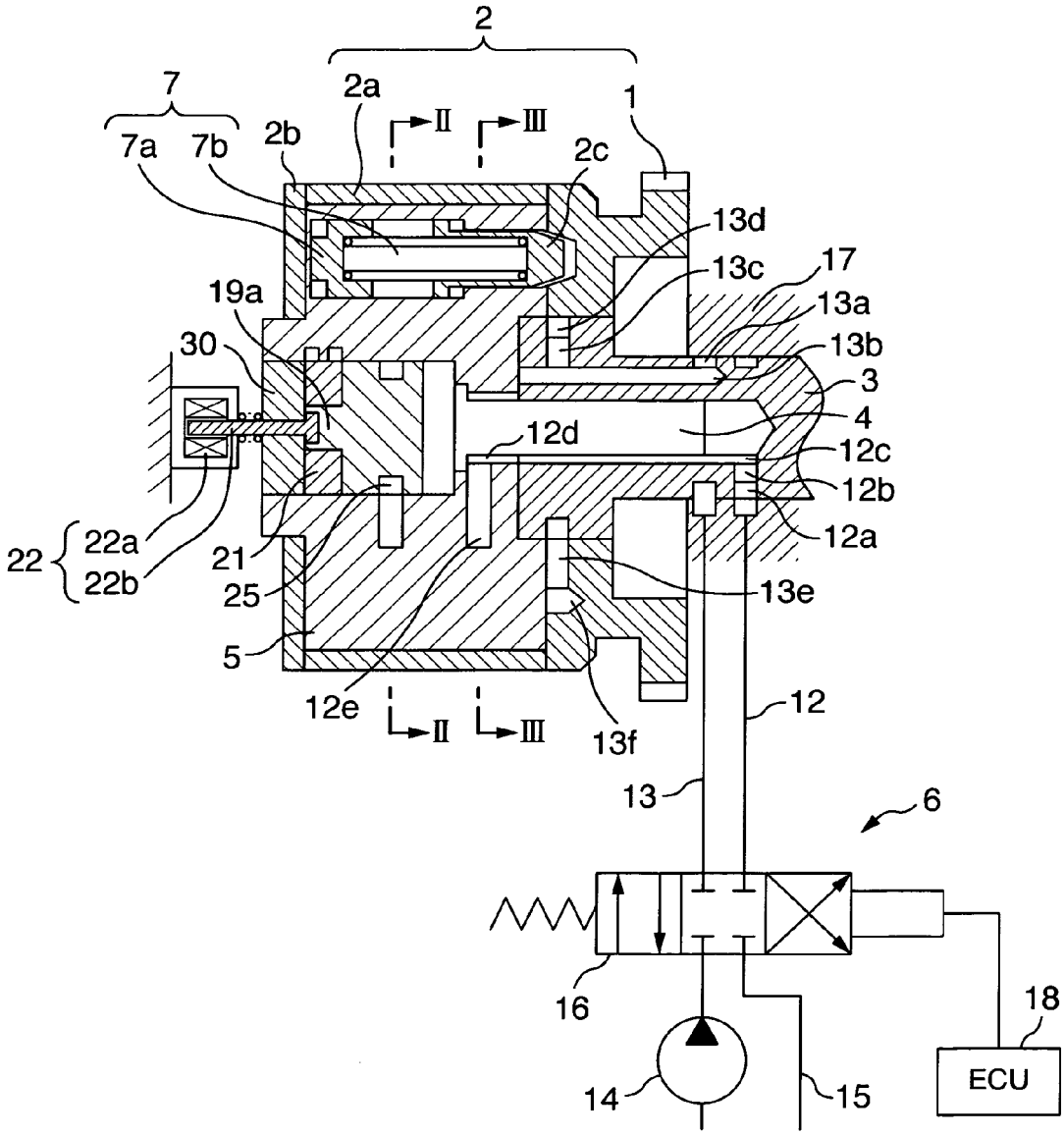
FIG. 1 is a cross sectional view of a first embodiment in accordance with the present invention.
Figure 2:
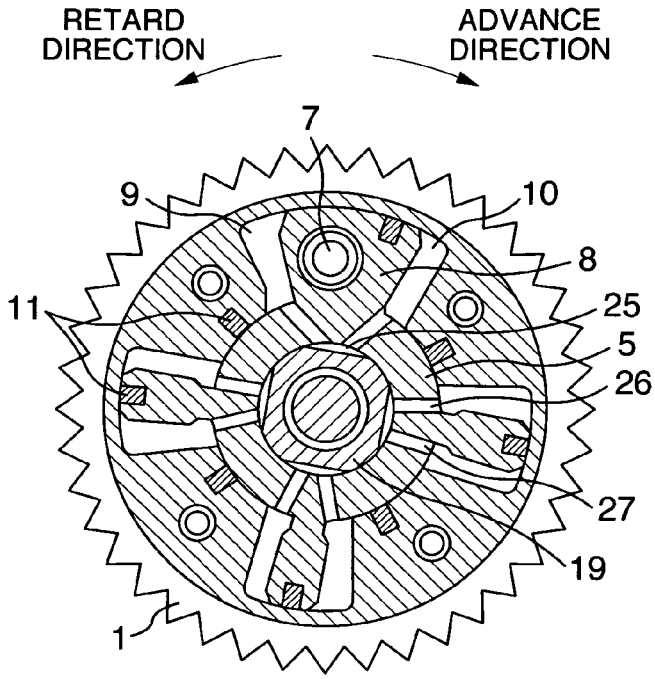
FIG. 2 is a view showing a state in which a hydraulic groove 25 and hydraulic passages 26 and 27 are communicated in a cross section II—II in FIG. 1.
Figure 3:
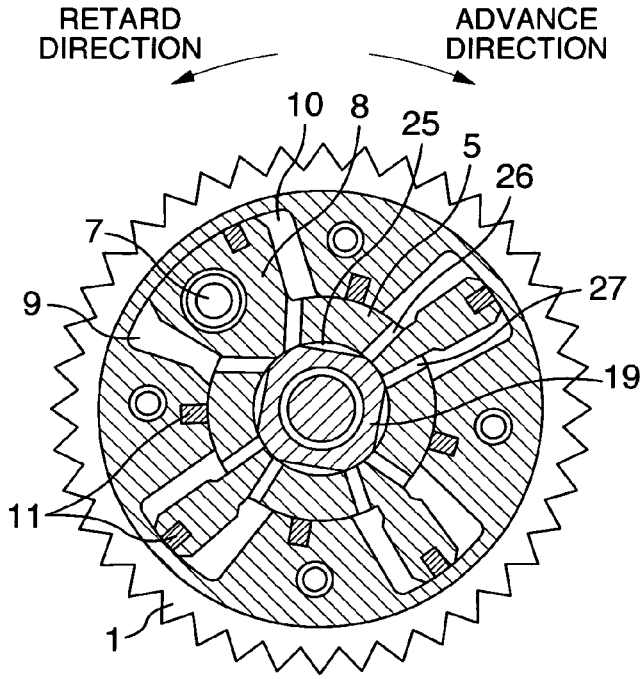
FIG. 3 is a view showing a state in which the hydraulic groove 25 and the hydraulic passages 26 and 27 are not communicated in a cross section along a line II—II in FIG. 1.
Figure 4:
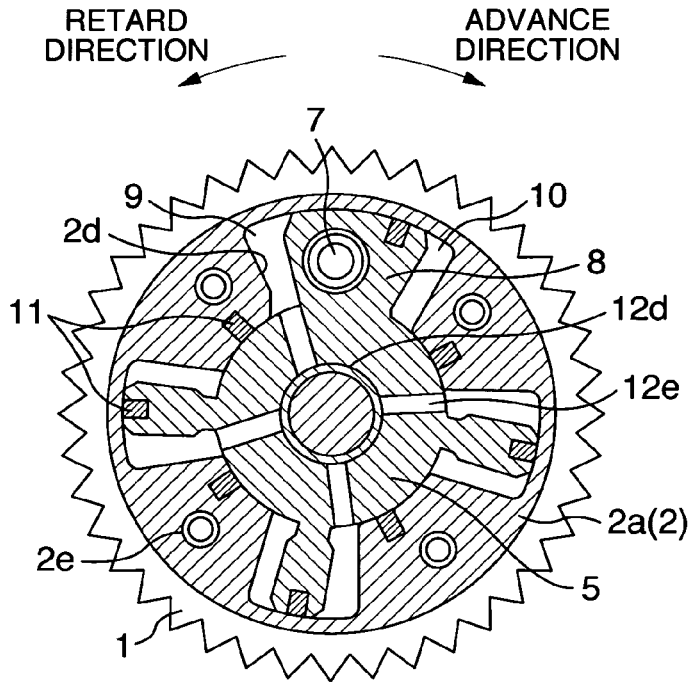
FIG. 4 is a cross sectional view along a line III—III in FIG. 1 showing the first embodiment in accordance with the present invention.
Figure 5:
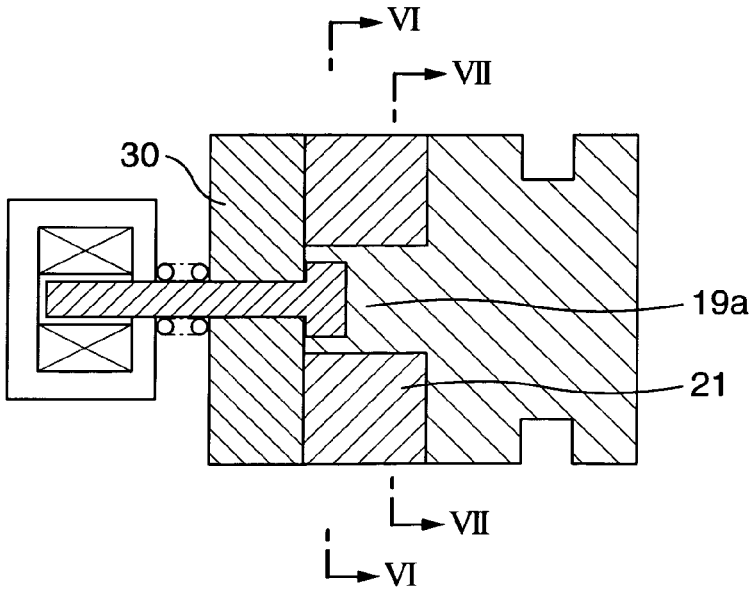
FIG. 5 is a partly enlarged view of the first embodiment in accordance with the present invention.
Figure 6:
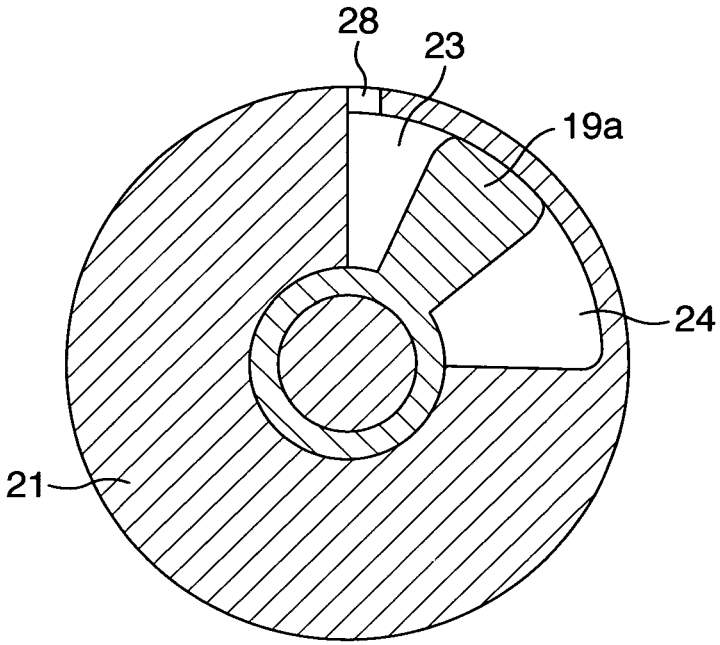
FIG. 6 is a cross sectional view along a line VI—VI in FIG. 5 showing the first embodiment in accordance with the present invention.
Figure 7:
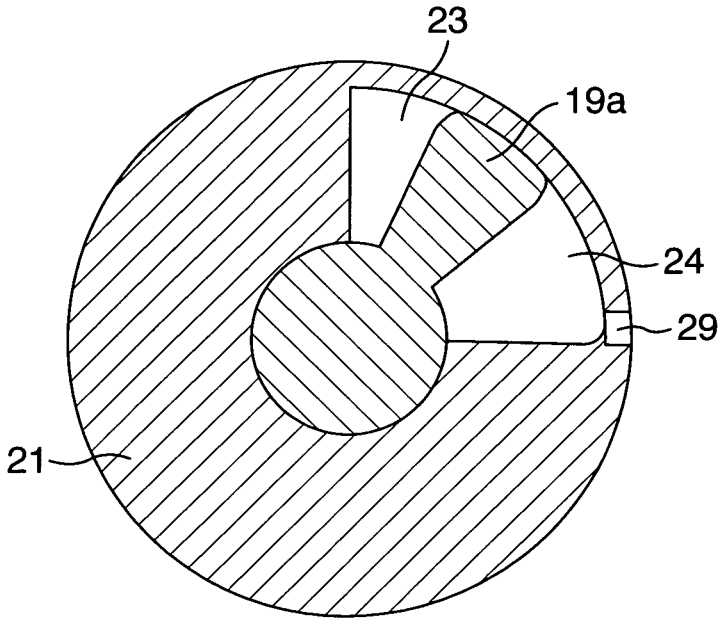
FIG. 7 is a view showing a cross section along a line VII—VII in FIG. 5.

A description will be given of a first embodiment in accordance with the present invention with reference to FIGS. 1 to 7 and 11.

A variable valve timing control apparatus is provided with a chain sprocket 1 rotationally driven by a crank shaft via a timing chain (not shown), a housing 2 forming a first rotary member in which the chain sprocket 1 is integrally formed, a cam shaft 3 assembled in one end portion in such a manner that the housing 2 can rotate, a vane rotor 5 integrally connected to one end of the cam shaft 3 by a cam bolt 4, and forming a second rotary member rotatably received in an inner portion of the housing 2, a hydraulic pressure supply and discharge means 6 for relatively rotating the vane rotor 5 with respect to the housing 2 by a hydraulic pressure in correspondence to an engine operating state, a lock mechanism 7 inhibiting a relative rotation of the housing 2 and the vane rotor 5 at a time of starting the engine or the like, and a phase angle control slider (which is sometimes called as a slider member) 19 allowing to selectively utilize positive and negative variable torques of the cam shaft 3 in the manner mentioned below.

The housing 2 is constituted by a housing main body 2*a*, and a housing side plate 2*b* closely fixed to a side portion of the housing main body 2*a*, and the housing side plate 2*b* can be fixed to the housing main body 2*a* by a fixing means 2*e*. The housing main body 2*a* is structured such that an outer shape is formed in a cylindrical shape, four recess portions and a round space portion in a center portion integrating the recess portions are provided in an inner portion, an inner peripheral surface of four convex portions formed with respect to the recess portions is formed in a cylindrical shape, and a center portion of the vane rotor 5 is arranged within a circumference.

The vane rotor 5 is connected to a front end portion of the cam shaft 3 by the cam bolt 4, and the vane rotor 5 is provided with four vanes 8 in a radial pattern on an outer peripheral surface thereof. Three of them are formed in the same shape, and the other one is formed so as to have a larger area than the other three. Accordingly, the recess portion in which the larger vane 8 is placed is large. The vane rotor 5 is arranged in an axial center position of the housing 2, and each of the vanes 8 is arranged between adjacent partition walls 2*d* of the housing 2. A space formed between one side surface of each of the vanes 8 in the vane rotor 5 and the partition wall 2*d* of the housing facing thereto is formed as an advance hydraulic chamber 9, and a space formed between the other side surface of each of the vanes 8 and the other partition wall 2*d* of the housing 2 facing thereto is formed as a retard hydraulic chamber 10. A seal member 11 energized by a spring is attached to each of the vanes 8 and the convex portions of the housing main body 2*a*, and seals the advance hydraulic chamber 9 and the retard hydraulic chamber 10 which are adjacent to each other.

The vane rotor 5 and the cam shaft 3 are fixed by the cam bolt 4 passing through holes formed in respective axial center positions thereof, and the cam shaft 3 and the cam bolt 4 are fastened by screw.

The hydraulic pressure supply and discharge means 6 has a first oil passage 12 supplying and discharging the hydraulic pressure to each of the advance hydraulic chambers, and a second oil passage 13 supplying and discharging the hydraulic pressure to each of the retard hydraulic chambers 10. An oil pump 14 and a drain oil path 15 are respectively connected to the first oil passage 12 and the second oil passage 13 via an electromagnetic change valve 16 for switching the passages.

The first oil passage 12 is communicated with a first communication path 12*b* and a first oil supply path 12*c* via a first oil groove 12*a* annularly formed in the cam shaft 3 from an inner side of a cylinder head 17. The first oil supply path 12*c* is communicated with four first oil supply holes 12*e* formed in a portion of the vane 8 of the vane rotor 5 via an oil chamber 12*d* annularly formed in the periphery of the cam bolt 4 in an axial bottom portion of the vane rotor 5, and the first oil supply holes 12*e* are communicated with the respective advance hydraulic chambers 9.

The second oil passage 13 is communicated with a second oil supply path 13*b*, a second communication path 13*c* and an annular oil groove 13*d* via a second oil groove 13*a* annularly formed in the cam shaft 3 from the inner side of the cylinder head 17. The annular oil groove 13*d* is communicated with the respective retard hydraulic chambers 10 via four oil groove communication paths 13*e* and second oil supply holes 13*f* formed in the end cover 2*c*.

An electromagnetic change valve 16 is of a type having four ports and three positions, is structured such that a valve body in an inner portion is controlled so as to be relatively switched to the first and second oil passages 12 and 13, the oil pump 14 and the drain oil path 15, and is activated so as to be changed on the basis of a control signal from an ECU 18 corresponding to a control apparatus. The ECU 18 detects an operating state on the basis of signals from a crank angle sensor detecting an engine rotational speed and an air flow meter detecting an intake air amount. Further, the ECU 18 detects a relative rotational position of the chain sprocket 1 and the cam shaft 3 on the basis of signals from a crank angle sensor and a cam angle sensor.

A lock mechanism 7 is provided in the largest vane 8. The lock mechanism 7 is a hydraulic piston type stopper mechanism constituted by a lock pin 7*a*, a retainer 7*b* and the like. A spring force is energized to the lock pin 7*a* in the retainer 7*b*, a hydraulic pressure of the retard hydraulic chamber 10 is applied to a collar-shaped portion (in the retainer 7*b* side) of the lock pin 7*a*, and a hydraulic pressure of the advance hydraulic chamber 9 is applied to the end cover 2*c* side provided in a leading end portion of the lock pin 7*a*.

Accordingly, the lock pin 7*a* is structured such that the leading end portion of the lock pin 7*a* is fitted into the groove formed in the end cover 2*c* until the hydraulic pressure of the advance hydraulic chamber 10 reaches a predetermined pressure at a time of an engine start, and the vane rotor 5 and the housing main body 2*a* are integrally rotated. Further, when the hydraulic pressure of the advance hydraulic chamber 10 reaches the predetermined pressure, the lock pin 7*a* is moved against the spring force, and the vane rotor 5, the housing main body 2*a* and the cam shaft 3 can be relatively rotated.

The vane rotor 5 has a cylindrical hole portion in an axial center portion. The phase angle control slider 19 forming the third rotary member is received in the hole portion provided in the axial center portion of the vane rotor 5 so as to freely rotate and move linearly. The phase angle control slider 19 has a slider portion vane rotor 19*a* forming a control member in a leading end portion thereof, and can rotate and move in a linear moving direction within the hole portion integrally together with the slider portion vane rotor 19*a*. The phase angle control slider 19 is provided with a slider housing 21 having a fan-shaped space portion in a leading end portion thereof. The slider portion vane rotor 19*a* rotates in the space portion in such a manner that a rotating range is limited by a wall in a trailing end of the space portion. The slider portion housing 21 is sectioned by the slide portion vane rotor 19*a*, and forms a slider portion advance hydraulic chamber 23 and a slide portion retard hydraulic chamber 24 by utilizing the space portion. Both ends of the slider portion housing 21 are sectioned by the end surface of the phase angle control slider 19 and the slider portion cover 30. The slider portion cover 30 is attached to the slider portion housing 21.

An outer peripheral surface of the phase angle control slider 19 is formed by a combination of a square shape and a circular shape, and a hydraulic chamber connecting groove 25 forming four hydraulic connecting passage portions is formed in an elongated shape at an interval of 90 degree at positions having an approximately uniform distance from the end surface of the slider 19 in the square shape surface of the outer peripheral surface of the phase angle control slider 19, by utilizing the square shape surface and the hole shape of the vane rotor 5. Four advance communicating passages 26 and retard communicating passages 27 forming the communicating passages are provided in the vane rotor 5 in such a manner as to communicate the hydraulic chamber connecting groove 25 with the advance hydraulic chamber 9 and the retard hydraulic chamber 10.

In an outer peripheral portion forming the space portion of the slider portion housing 21, there are formed a slider portion first oil supply hole 28 supplying and discharging the hydraulic pressure with respect to the slider portion advance hydraulic chamber 23, and a slider portion second oil supply hole 29 supplying and discharging the hydraulic pressure with respect to the slide portion retard hydraulic chamber 24. The slider portion first oil supply hole 28 is communicated with the first oil passage 12 which is also communicated with the advance hydraulic chamber 9, and the slider portion second oil supply hole 29 is communicated with the second oil passage 13 which is also communicated with the retard hydraulic chamber 10.

The slider portion housing 21 is regulated in the motion in the rotational direction. When the slide portion vane rotor 19*a* is positioned in a state in which the slider portion advance hydraulic chamber 23 disappears, that is, when the slide portion vane rotor 19*a* is brought into contact with the wall of the slider portion advance hydraulic chamber 23, the slider portion housing 21 is fixed to such a rotational angle that the positive variable torque of the cam shaft 3 reaches the maximum value, or the value in the vicinity thereof. In this case, the value near the maximum value is used as a meaning including the maximum value.

The electromagnetic solenoid 22 forming the position control means is regulated by an electromagnetic force in the motion in the rotational direction and the linear moving direction, and is fixed to a portion of the engine main body which does not execute the rotational and linear motion. The iron core 22*b* can move only in the straight moving direction in view of the function of the electromagnetic solenoid 22, and moves integrally together with the slider portion housing 21 and the slider portion cover 30. The phase angle slider 19 is rotatably connected to the iron core 22*b* of the electromagnetic solenoid 22, and a movable range in the rotational direction is regulated at 45 degree by the slider portion housing 21. Of course, the regulated angle is variable in accordance with the number of cylinders in the engine.

In the present embodiment, the hydraulic chamber connecting grooves 25 are arranged at a uniform interval on the circumference of the phase angle control slider 19, however, it is not necessary to be arranged at the uniform interval as far as at a phase angle capable of utilizing the variable torque in a desired rotational direction. Further, the number of the hydraulic chamber connecting grooves 25 is different in accordance with the engine type.

For example, in the case of an in-line four-cylinder engine, at least four cams having different valve timings are attached to one cam shaft, and rotational phases thereof are different at 90 degree. Accordingly, it is preferable that four hydraulic chamber connecting grooves 25 are arranged at an interval of 90 degree in a state in which the center positions are arranged on the circumference of the phase angle control slider 19. However, as far as the phase angle can utilize the variable torque in the desired rotational direction mentioned above, it is preferable that at least one hydraulic chamber connecting groove 25 is provided, and it is not necessary that the hydraulic chamber connecting grooves 25 are arranged at the uniform interval. In the case of a V-type six-cylinder engine, at least three cams having different valve timings are attached to one cam shaft, and phases thereof are different at 120 degree. Accordingly, it is preferable that three hydraulic chamber connecting grooves 25 are arranged at an interval of 120 degree in a state in which the center positions thereof are arranged on the circumference of the phase angle control slider 19. However, as far as the phase angle can utilize the variable torque in the desired rotational direction mentioned above, it is preferable that at least one hydraulic chamber connecting groove 25 is provided, and it is not necessary that the hydraulic chamber connecting grooves 25 are arranged at the uniform interval. As mentioned above, a plurality of closed spaces are formed at the shifted angles in the circumferential direction, and are communicated with the groove portions forming the hydraulic chamber connecting groove at the different timings.

A description will be given of an operation of the variable valve timing control apparatus having the structure mentioned above.

At a time of an engine start and an idling operation, the electromagnetic switch valve 16 communicates the oil pump 14 with the second oil passage 13, and communicates the drain oil path 15 with the first oil passage 12. Accordingly, the hydraulic pressure is supplied to the retard hydraulic chamber 10 from the second oil passage 13 via the second oil groove 13*a*, the second oil supply path 13*b*, the second communicating path 13*c*, the annular oil groove 13*d*, the oil groove communicating path 13*e* and the second oil supply path 13*f*. Since no hydraulic pressure is supplied to the advance hydraulic chamber 9, the advance hydraulic chamber 9 is in a low pressure state in comparison with the retard hydraulic chamber 10. Accordingly, the vane 8 is regulated in motion by the partition wall 2*d*, and is maintained at a position in which the space of the advance hydraulic chamber is minimum. The case that the vane 8 is in a position relation with respect to the housing main body 2*a* is called as a most retarded position.

At a time of the engine start, the vane rotor 5 is regulated in the relative rotation with respect to the housing main body 2*a* by the lock pin 7*a* of the lock mechanism 7. Accordingly, even in a state in which the engine rotational speed is low and no sufficient hydraulic pressure can be supplied from the oil pump 14 such as the engine start time, it is possible to prevent the vane rotor 5 from generating an oscillating vibration due to the positive and negative rotational variable torque.

After the vane rotor 5 is in the state of being held at the most retarded position, the electromagnetic change valve 16 is switched on the basis of the command of the ECU 18 so as to communicate the oil pump 14 with the first oil passage 12, and communicate the drain oil path 15 with the second oil passage 13, whereby the lock mechanism 7 is cancelled by the hydraulic pressure. At the same time, the high-pressure oil is supplied to the advance hydraulic chamber 9 via the first oil passage 12, and is supplied to the advance hydraulic chamber 9 via the first oil groove 12*a*, the first communication path 12*b*, the first oil supply path 12*c*, the oil chamber 12*d* and the first oil supply hole 12*e*. Accordingly, since the pressure in the advance hydraulic chamber 9 becomes higher in comparison with the retard hydraulic chamber 10, the vane rotor 5 rotates in the advance direction with respect to the housing 2 which is integrally formed with the chain sprocket 1.

In this case, when rotating the vane rotor 5 in the advance direction with respect to the housing 2, the ECU 18 outputs an ON command to the electromagnetic solenoid 22 at the same time of the switch command of the electromagnetic change valve 16. Accordingly, the phase angle control slider 19 is moved in the axial direction, and the hydraulic chamber connecting groove 25 formed in the phase angle control slider 19 is intermittently communicated with the advance chamber communication path 26 and the retard chamber communication path 27. Further, the slider portion advance hydraulic chamber 23 is supplied the hydraulic pressure from the same oil supply path as the advance hydraulic chamber 9 through the slider portion first oil supply hole 28, and the slider portion retard hydraulic chamber 26 is supplied the hydraulic pressure from the same oil supply path as the retard hydraulic chamber 10 through the slider portion second oil supply hole 27. Accordingly, the hydraulic pressure of the slider portion advance hydraulic chamber 23 is higher than the pressure in the slider portion retard hydraulic chamber 24, and the slider portion vane rotor 19*a* is moved to a position in which the slider portion retard hydraulic chamber 24 disappears. Since the phase angle control slider 19 is rotated integrally together with the slider portion vane rotor 19*a*, the phase angle control slider 19 is maintained at the similar position.

At this time, the hydraulic chamber connecting groove 25, the advance chamber communication path 26 and the retard chamber communication path 27 are communicated at the timing in the vicinity of the timing when the negative variable torque of the cam shaft 3 reaches the maximum value.

Figure 11:
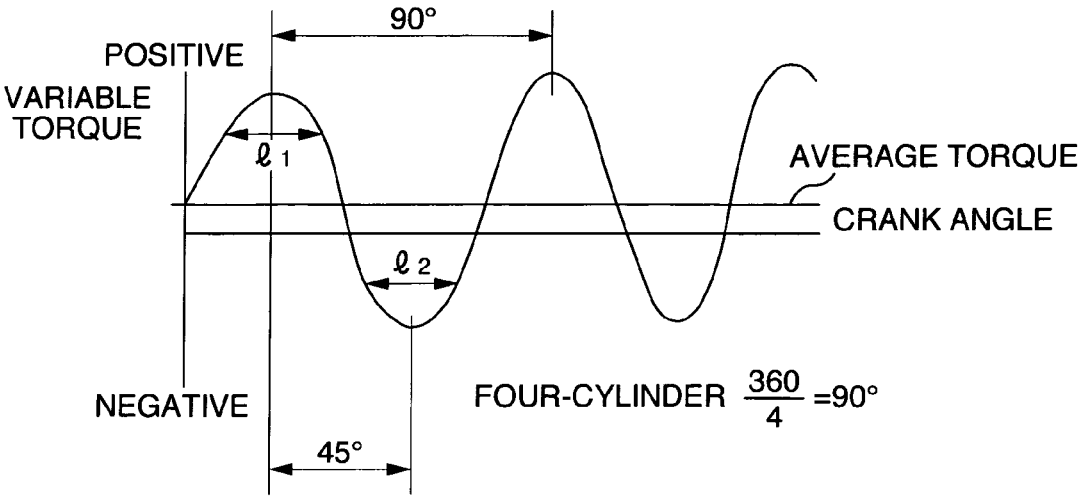
FIG. 11 is a view showing a relation between a variable torque applied to a cam shaft and a crank angle.
Figure 12:
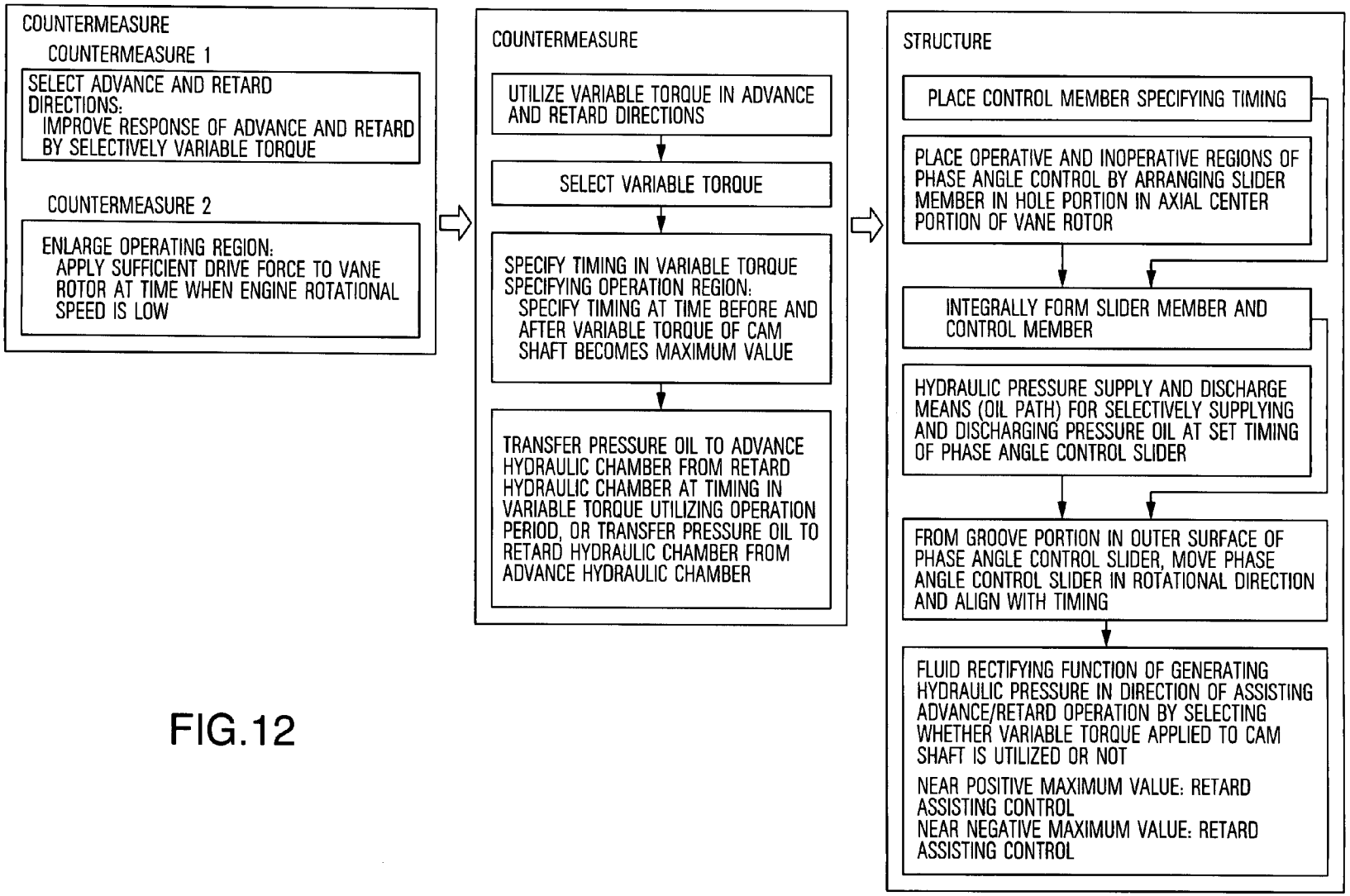
FIG. 12 is a view showing a concept of the present invention.

FIG. 11 shows a relation between the variable torque applied to the cam shaft 3 and the crank angle (in the case of the four-cylinder). The variable torque appears in the positive and negative sides as shown by the drawing (90 degree between peaks), and an average torque exists in the positive side. The timings before and after reaching the maximum values corresponding to the respective peak values are expressed by lengths 11 and 12. An operating hydraulic pressure for rotationally operating the slider portion vane rotor 19*a* at a specified phase angle is generated.

When the negative variable torque rotating the vane rotor 5 in the advance direction is applied, the oil in the retard hydraulic chamber 10 is pressure fed to the advance hydraulic chamber 9 via the retard chamber communication path 27, the hydraulic chamber connecting groove 25 and the retard chamber communication path 26, so that the vane rotor 5 is relatively rotated in the advance direction with respect to the housing 2.

In the case of rotating the vane rotor 5 in the retard direction with respect to the housing 2, the electromagnetic change valve 16 is switched on the basis of the command of the ECU 18 so as to communicate the oil pump 14 with the second oil passage 13 and communicate the drain oil path 15 with the first oil passage 12. At this time, the high-pressure oil is supplied to the retard hydraulic chamber 10 via the second oil passage 13, and via the second oil groove 13*a*, the second oil supply path 13*b*, the second communication path 13*c*, the annular oil groove 13*d*, the oil groove communication path 13*e* and the second oil supply hole 13*f*. Accordingly, since the pressure in the retard hydraulic chamber 10 becomes higher in comparison with the advance hydraulic chamber 9, the vane rotor 5 is rotated in the retard direction with respect to the housing 2 integrally formed with the chain sprocket 1.

In this case, when rotating the vane rotor 5 in the retard direction, the ECU 18 outputs the ON command to the electromagnetic solenoid 22 at the same time of the switch command of the electromagnetic change valve 16 if the electromagnetic solenoid 22 is in an OFF state. Accordingly, the phase angle control slider 19 is moved in the axial direction, and the hydraulic chamber connecting groove 25 formed in the phase angle control slider 19 is intermittently communicated with the advance chamber communication path 26 and the retard chamber communication path 27.

Further, the slider portion advance hydraulic chamber 23 is supplied the hydraulic pressure from the same oil supply path as the advance hydraulic chamber 9 through the slider portion first oil supply hole 28, and the slider portion retard hydraulic chamber 26 is supplied the hydraulic pressure from the same oil supply path as the retard hydraulic chamber 10 through the slider portion second oil supply hole 27. Accordingly, the hydraulic pressure in the slider portion retard hydraulic chamber 24 becomes higher then the pressure in the slider portion advance hydraulic chamber 23, and the slider portion vane rotor 19*a* is moved to the position in which the slider portion advance hydraulic chamber 23 disappears. Since the phase angle control slider 19 is rotated integrally together with the slider portion vane rotor 19*a*, the phase angle control slider 19 is maintained at the similar position.

At this time, the hydraulic chamber connecting groove 25, the advance chamber communication path 26 and the retard chamber communication path 27 are communicated at the timing before and after the positive variable torque of the cam shaft 3 reaches the maximum value. Since the positive variable torque corresponding to the torque rotating the vane rotor 5 in the retard direction is applied, and the oil in the advance hydraulic chamber 9 is pressure fed to the retard hydraulic chamber 10 via the advance chamber communication path 26, the hydraulic chamber connecting groove 25 and the retard chamber communication path 27, the vane rotor 5 is relatively rotated in the retard direction with respect to the housing 2.

In the case that the vane rotor 5 is held at the desired rotational position with respect to the housing 2, the hydraulic pressure is kept in a balanced state by switching the electromagnetic change valve 16 and cutting off the communication between the first oil passage 12 and the second oil passage 13 with the oil pump 14 and the drain oil path 15.

Further, at the same time, the electromagnetic solenoid 22 is turned off so as to move the phase angle control slider 19 in the axial direction, be maintained at a position in which the hydraulic chamber connecting groove 25 formed in the phase angle control slider 19 is not communicated with the advance chamber communication path 26 and the retard chamber communication path 27, and select the state in which the variable torque is not utilized.

As mentioned above, there is provided a valve timing control apparatus comprising:

a first rotary member rotationally driven in synchronous with a crank shaft of an engine;

a second rotary member connected to a cam shaft so as to be rotationally driven;

an advance hydraulic chamber and a retard hydraulic chamber formed by utilizing the first rotary member and the second rotary member, and increasing or reducing a volumetric capacity by a relative rotational direction while working with a relative rotation of both the rotary members; and the valve timing control apparatus changing a rotational phase of the cam shaft by selectively supplying and discharging an oil from a hydraulic pressure supply and discharge means with respect to the advance hydraulic chamber and the retard hydraulic chamber so as to change an opening and closing timing of an intake valve or an exhaust valve, wherein a hole portion in an axial center portion of the second rotary member is provided with a third rotary member having a control member, a rotation control portion controlling a rotating range of the control member, formed by a space portion, and an advance hydraulic chamber communication chamber and a retard hydraulic chamber communication chamber formed by being sectioned by the control member while using a part of the space portion, and structured such that a pressure oil is supplied to the communication chambers from the hydraulic pressure supply and discharge means, and a hydraulic pressure connecting passage portion integrally rotating with the control member and provided in a circumferential surface opposing to an inner peripheral surface of the second rotary member, and a communication path communicating with each of the advance hydraulic chamber and the retard hydraulic chamber provided in the second rotary member is intermittently communicated with the hydraulic pressure connecting passage in the case that the rotating range of the control member is controlled and the relative rotation of the third rotary member and the second rotary member stops.

Embodiment 2

Figure 8:
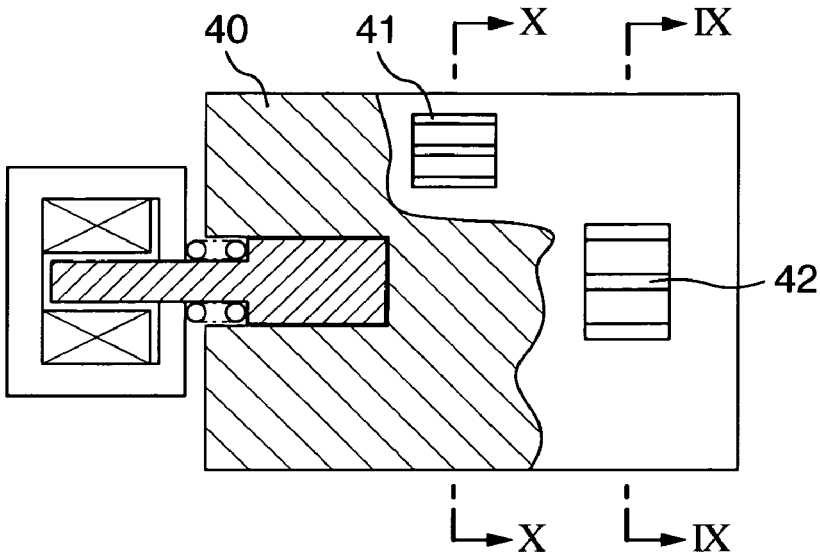
FIG. 8 is a partly enlarged view of a second embodiment in accordance with the present invention.

A description will be given of a second embodiment in accordance with the present invention with reference to FIGS. 8 to 10.

A basic structure of the second embodiment is the same as that of the first embodiment, and the second embodiment is different from the first embodiment in a point of a shape of the phase angle control slider 19, and a stop position of the electromagnetic solenoid 22 in the axial direction being determined in three stages. Accordingly, the description of the embodiment 1 is applied to the common structure.

The phase angle control slider 40 is received in the hole portion provided in the axial center portion of the vane rotor 5 so as to freely move linearly, and can be moved in the straight moving direction.

The electromagnetic solenoid 22 is regulated in the motion in the rotational direction and the linear moving direction, and is fixed to the portion of the engine main body which does not execute the rotational and linear motion. The iron core 22*b* can move only in the straight moving direction in view of the function of the electromagnetic solenoid 22, and moves integrally together with the phase angle control slider 40. Accordingly, a phase angle control slider 40 is integrally formed with the iron core 22*b*, moves only in the straight moving direction, and is regulated in the motion in the rotational direction.

Four advance connecting grooves 41 are arranged at position having a uniform distance from an end surface of the phase angle control slider 40 at an interval of 90 degree, on an outer peripheral surface of the phase angle control slider 40, and four retard connecting grooves 42 are provided at positions which have a uniform distance from the end surface of the phase angle control slider 40, does not lap over the advance connecting grooves 41 and are shifted at a phase of 45 degree, with an interval of 90 degree. Four advance chamber communication paths 26 and retard chamber communication paths 27 are provided in the vane rotor 5 in such a manner as to communicate the advance connecting groove 41 or the retard connecting groove 42 with the advance hydraulic chamber 9 and the retard hydraulic chamber 10. Both the connecting grooves 41 and 42 are provided with a function by which the oil tends to flow in only one direction, for example, a projection 43 shown in FIG. 7. The projection 43 is provided in the advance connecting groove 41 in such a manner that the oil tends to flow only in the direction from the retard chamber communication path 27 to the advance chamber communication path 26, and in the retard connecting groove 42 in such a manner that the oil tends to flow only in the direction from the advance chamber communication path 26 to the retard chamber communication path 27.

In the present embodiment, both the connecting grooves 41 and 42 are formed so as to be arranged at the uniform interval on a circumference of the phase angle control slider 40, however, the uniform interval is not necessary as far as the phase angle can utilize the variable torque in the desired rotational direction. Further, the number of both the connecting grooves 41 and 42 is different in accordance with the engine type.

For example, in the case of an in-line four-cylinder engine, at least four cams having different valve timings are attached to one cam shaft, and rotational phases thereof are different at 90 degree. Accordingly, it is preferable that both the connecting grooves 41 and 42 are structured such that four hydraulic chamber connecting grooves 25 are arranged at an interval of 90 degree in a state in which the center positions are arranged on the circumference of the phase angle control slider 19. However, as far as the phase angle can utilize the variable torque in the desired rotational direction mentioned above, it is preferable that at least one advance connecting groove 41 and retard connecting groove 42 are provided, and it is not necessary that the connecting grooves 41 and 42 are arranged at the uniform interval. Further, it is preferable that the phase of the advance connecting groove 41 and the retard connecting groove 42 are set to 45 degree which is one half of 90 degree corresponding to the rotational phase of the valve timing, however, it is not necessary that the phase is 45 degree as far as the phase can utilize the variable torque in the desired rotational direction.

In the case of a V-type six-cylinder engine, at least three cams having different valve timings are attached to one cam shaft, and rotational phases thereof are different at 120 degree. Accordingly, it is preferable that three connecting grooves 41 and 42 are arranged at an interval of 120 degree in a state in which the center positions thereof are arranged on the circumference of the phase angle control slider 19. However, as far as the phase angle can utilize the variable torque in the desired rotational direction mentioned above, it is preferable that at least one advance connecting groove 41 and retard connecting groove 42 are provided, and it is not necessary that the connecting grooves 41 and 42 are arranged at the uniform interval. Further, it is preferable that the phase of the advance connecting groove 41 and the retard connecting groove 42 is 60 degree which is one half of 120 degree corresponding to the rotational phase of the valve timing, however, it is not necessary that the phase is 60 degree as far as the phase can utilize the variable torque in the desired rotational direction.

The electromagnetic solenoid 22 is regulated in the motion in the rotational and straight moving directions, and is fixed to the portion of the engine main body which does not execute the rotational and linear motion. The iron core 22*b* can move only in the straight moving direction in view of the function of the electromagnetic solenoid 22, and moves in three stages integrally together with the phase angle control slider 40. One stage of three stages is set to a position communicating the advance connecting groove 41 with the advance chamber communication path 26 and the retard chamber communication path 27, one stage is set to a position communicating the retard connecting groove 42 with the advance chamber communication path 26 and the retard chamber communication path 27, and the other one stage is set to a wall surface position of the phase angle control slider 40 at which the advance chamber communication path 26 and the retard chamber communication path 27 are not communicated with both the connecting grooves 41 and 42.

A description will be given of an operation of the variable valve timing control apparatus having the structure mentioned above.

A basic operation is the same as the first embodiment. The operation is different in an operation of the phase angle control slider 40 for utilizing the variable torque of the cam shaft 3, and a description will be given of this point.

When rotating the vane rotor 5 in the advance direction with respect to the housing 2, the ECU 18 outputs an ON command to the electromagnetic solenoid 22 at the same time of the switch command of the electromagnetic change valve 16, thereby moving the phase angle control slider 40 in an axial direction to a position at which the advance chamber communication path 26 and the retard chamber communication path 27 are intermittently communicated via the advance connecting groove 41. At this time, the advance chamber communication path 26 and the retard hydraulic chamber 10 are communicated with the advance connecting groove 41 at the timing before and after the negative variable torque of the cam shaft 3 reaches the maximum value. Accordingly, when the negative variable torque rotating the vane rotor 5 in the advance direction is applied, the oil in the retard hydraulic chamber 10 is pressure fed to the advance hydraulic chamber 9 via the retard chamber communication path 27, the advance connecting groove 41 and the advance chamber communication path 26, and the vane rotor 5 is relatively rotated in the advance direction with respect to the housing 2.

When rotating the vane rotor 5 in the retard direction with respect to the housing 2, the ECU 18 switches the electromagnetic solenoid 22 at the same time of outputting the switch command of the electromagnetic change valve 16, thereby moving the phase angle control slider 40 in an axial direction to a position at which the advance chamber communication path 26 and the retard chamber communication path 27 are intermittently communicated via the retard connecting groove 42. At this time, the advance chamber communication path 26 and the retard communication path 27 are communicated with the retard connecting groove 42 at the timing before and after the positive variable torque of the cam shaft 3 reaches the maximum value. Accordingly, when the positive variable torque rotating the vane rotor 5 in the retard direction is applied, the oil in the advance hydraulic chamber 9 is pressure fed to the retard hydraulic chamber 10 via the advance chamber communication path 26, the retard connecting groove 42 and the retard chamber communication path 27, and the vane rotor 5 is relatively rotated in the retard direction with respect to the housing 2.

In the case of holding the vane rotor 5 at the desired rotational position with respect to the housing 2, the electromagnetic solenoid 22 is switched at the same time of switching the electromagnetic change valve 16, and the phase angle control slider 40 is moved in the axial direction to the position in which the advance chamber communication path 26 and the retard chamber communication path 27 are not communicated with the advance connecting groove 41 and the retard connecting groove 42. A state in which the variable torque is not utilized is selected.

Figure 9:
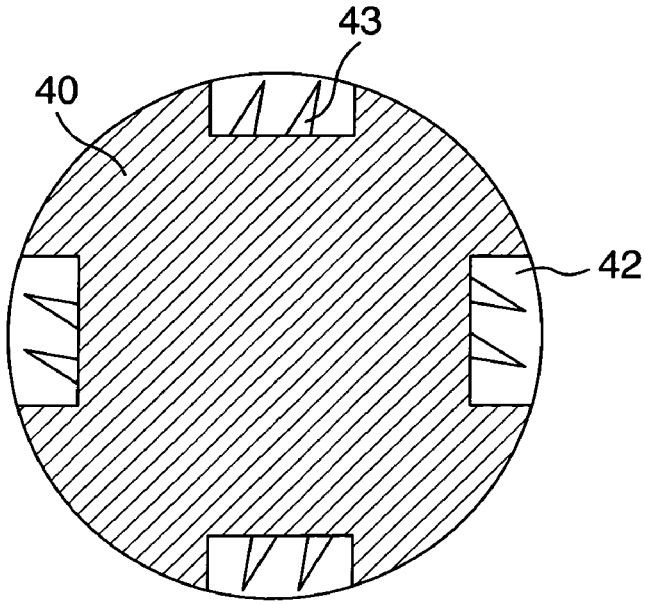
FIG. 9 is a cross sectional view along a line IX—IX in FIG. 8 showing the second embodiment in accordance with the present invention.
Figure 10:
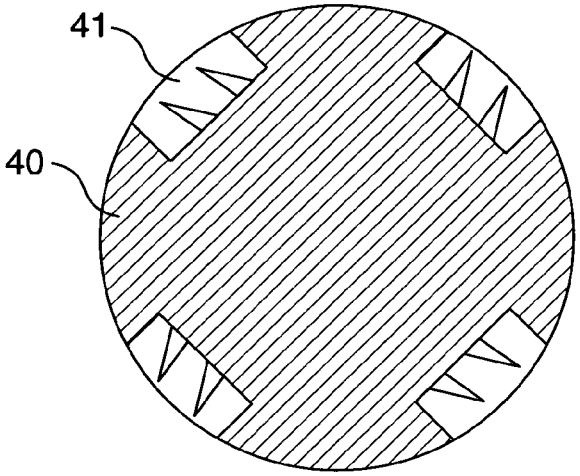
FIG. 10 is a view showing a cross section along a line X—X in FIG. 8.

A description will be given of a concept of the present invention by using FIG. 9 showing a block diagram of the concept with reference to two embodiments mentioned above.

In accordance with a countermeasure 1, the response of the advance/retard is improved by selectively utilizing the variable torque of the cam shaft, and in accordance with a countermeasure 2, the working region is enlarged by applying the sufficient drive force to the vane rotor at a time when the engine rotational speed is low. In response to this, the variable torque in the advance and retard direction is utilized, and the variable torque can be selectively utilized. The timing for utilizing the variable torque is specified in the specified region of the variable torque. In accordance with one example of the specified timing, the timing is specified to the phase angle (time) before and after the variable torque of the cam shaft becomes the maximum value. The pressure oil is transferred to the advance hydraulic chamber from the retard hydraulic chamber at the timing of the used and operated period of the variable torque.

In accordance with a particular structure for achieving them, a control member for specifying the timing is set. One example corresponds to the slide portion vane rotor 19*a*. Further, the slider member (the phase control slider 19 in accordance with one example) is provided in the hole portion in the axial center portion of the vane rotor 5. A state of being operated and a state of being kept in an inoperative state are controlled by the slide member. In other words, the operative and inoperative motions are executed with respect to the phase angle control.

The slider member can be integrally structured with the control member, whereby the phase angle control slider 19 is structured. Accordingly, it is possible to form the hydraulic pressure supply and discharge means (the oil path) for selectively supplying and discharging the pressure oil at the set timing by using the phase angle control slider 19.

As shown in the embodiment 1 or the embodiment 2, the groove portion is formed in the outer surface (facing to the inner surface of the hole portion) of the phase angle control slider 19, and the phase angle control slider 19 is moved in the axially rotating direction and is aligned with the set timing. As the timing, the hydraulic pressure is moved to the direction of assisting the advance and retard motions by selecting whether or not the variable torque applied to the cam shaft is utilized.

In these cases, the control member and the phase angle control slider 19 provided with the groove portion in the outer surface are provided with the function serving as a fluid rectifying apparatus (means). In other words, the fluid rectifying apparatus has the control member generating the operating oil pressure at the specific phase angle of the variable torque while working with the variable torque of the cam shaft, is operated by the operating oil pressure, and has a function of controlling the communication paths respectively provided in the advance hydraulic chamber and the retard hydraulic chamber arranged in the second rotary member from the communication inhibiting state to the communicated state. The fluid rectifying apparatus can executed the control mentioned above by being provided within the hole portion of the vane rotor, thereby preventing an entire of the apparatus from being increased. Since the cam torque in the rotating direction is utilized, the response is improved.

As mentioned above, there is provided a valve timing control apparatus comprising:

a first rotary member rotationally driven in synchronous with a crank shaft of an engine;

a second rotary member connected to a cam shaft so as to be rotationally driven;

an advance hydraulic chamber and a retard hydraulic chamber formed by utilizing the first rotary member and the second rotary member, and increasing or reducing a volumetric capacity by a relative rotational direction while working with a relative rotation of both the rotary members; and the valve timing control apparatus changing a rotational phase of the cam shaft by selectively supplying and discharging an oil from a hydraulic pressure supply and discharge means with respect to the advance hydraulic chamber and the retard hydraulic chamber so as to change an opening and closing timing of an intake valve or an exhaust valve, wherein the valve timing control apparatus has a control member generating an operating force at a specific phase angle of the variable torque while working with the variable torque of the cam shaft, and is provided with a fluid rectifying apparatus operated by the operating force and controlling the communication path arranged in the advance hydraulic chamber and the retard hydraulic chamber formed in the second rotary member from a communication inhibiting state to a communicating state.

Further, there is provided an intake valve or opening and closing timing changing method by a valve timing control apparatus comprising:

a first rotary member rotationally driven in synchronous with a crank shaft of an engine;

a second rotary member connected to a cam shaft so as to be rotationally driven;

an advance hydraulic chamber and a retard hydraulic chamber formed by utilizing the first rotary member and the second rotary member, and increasing or reducing a volumetric capacity by a relative rotational direction while working with a relative rotation of both the rotary members; and the valve timing control apparatus changing a rotational phase of the cam shaft by selectively supplying and discharging an oil from a hydraulic pressure supply and discharge means with respect to the advance hydraulic chamber and the retard hydraulic chamber, wherein an operating force is generated at a phase angle near positive and negative maximum values of the variable torque while working with the variable torque of the cam shaft, and an opening and closing timing of the intake valve or the exhaust valve is changed by controlling the advance hydraulic chamber and the retard hydraulic chamber operated by the operating force and provided in the second rotary member from a communication inhibiting state to a communicating state so as to move the pressure oil from the retard hydraulic chamber to the advance hydraulic chamber at a time of the phase angle near the negative maximum value, and/or move the pressure oil from the advance hydraulic chamber to the retard hydraulic chamber at the phase angle near the positive maximum value.

Further, there is provided an opening and closing timing changing method of the intake valve or the exhaust valve by the valve timing control apparatus which variably sets an operative region for controlling the advance hydraulic chamber and the retard hydraulic chamber from the communication inhibiting state to the communicating state and an inoperative region in which the control is not executed.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A valve timing control apparatus comprising:

a first rotary member rotationally driven in synchronous with a crank shaft of an engine;

a second rotary member connected to a cam shaft so as to be rotationally driven;

an advance hydraulic chamber and a retard hydraulic chamber formed by utilizing the first rotary member and the second rotary member, and increasing or reducing a volumetric capacity by a relative rotational direction while working with a relative rotation of both the rotary members; and the valve timing control apparatus changing a rotational phase of the cam shaft by selectively supplying and discharging an oil from a hydraulic pressure supply and discharge means with respect to said advance hydraulic chamber and said retard hydraulic chamber so as to change an opening and closing timing of an intake valve or an exhaust valve, wherein a hole portion in an axial center portion of the second rotary member is provided with a third rotary member having a control member, a rotation control portion controlling a rotating range of said control member, and a hydraulic pressure connecting passage portion integrally rotating with said control member and provided in a circumferential surface opposing to an inner peripheral surface of the second rotary member, and a communication path communicating with each of said advance hydraulic chamber and the retard hydraulic chamber provided in the second rotary member is communicated with said hydraulic pressure connecting passage in the case that the rotating range of said control member is controlled and the relative rotation of the third rotary member and the second rotary member stops.

2. A valve timing control apparatus comprising:

a first rotary member rotationally driven in synchronous with a crank shaft of an engine;

a second rotary member connected to a cam shaft so as to be rotationally driven;

an advance hydraulic chamber and a retard hydraulic chamber formed by utilizing the first rotary member and the second rotary member, and increasing or reducing a volumetric capacity by a relative rotational direction while working with a relative rotation of both the rotary members; and the valve timing control apparatus changing a rotational phase of the cam shaft by selectively supplying and discharging an oil from a hydraulic pressure supply and discharge means with respect to said advance hydraulic chamber and said retard hydraulic chamber so as to change an opening and closing timing of an intake valve or an exhaust valve, wherein a hole portion in an axial center portion of the second rotary member is provided with a third rotary member having a control member, a rotation control portion controlling a rotating range of said control member, formed by a space portion, and an advance hydraulic chamber communication chamber and a retard hydraulic chamber communication chamber formed by being sectioned by said control member while using a part of said space portion, and structured such that a pressure oil is supplied to the communication chambers from the hydraulic pressure supply and discharge means, and a hydraulic pressure connecting passage portion integrally rotating with said control member and provided in a circumferential surface opposing to an inner peripheral surface of the second rotary member, and a communication path communicating with each of said advance hydraulic chamber and the retard hydraulic chamber provided in the second rotary member is intermittently communicated with said hydraulic pressure connecting passage in the case that the rotating range of said control member is controlled and the relative rotation of the third rotary member and the second rotary member stops.

3. A valve timing control apparatus as claimed in claim 1, wherein the valve timing control apparatus is provided with a position control means for moving said third rotary member in an axial direction within said hole portion, and controlling a position from an inhibiting state of the communication between said communicating path and said hydraulic pressure connecting passage to a communicating state.

4. A valve timing control apparatus as claimed in claim 2, wherein the valve timing control apparatus is provided with a position control means for moving said third rotary member in an axial direction within said hole portion, and controlling a position from an inhibiting state of the communication between said communicating path and said hydraulic pressure connecting passage to a communicating state.

5. A valve timing control apparatus comprising:

a first rotary member rotationally driven in synchronous with a crank shaft of an engine;

a second rotary member connected to a cam shaft so as to be rotationally driven;

an advance hydraulic chamber and a retard hydraulic chamber formed by utilizing the first rotary member and the second rotary member, and increasing or reducing a volumetric capacity by a relative rotational direction while working with a relative rotation of both the rotary members; and the valve timing control apparatus changing a rotational phase of the cam shaft by selectively supplying and discharging an oil from a hydraulic pressure supply and discharge means with respect to said advance hydraulic chamber and said retard hydraulic chamber so as to change an opening and closing timing of an intake valve or an exhaust valve, wherein the valve timing control apparatus has a control member generating an operating force at a specific phase angle of a variable torque while working with said variable torque of said cam shaft, and is provided with a fluid rectifying apparatus operated by the operating force and controlling the communication path arranged in said advance hydraulic chamber and the retard hydraulic chamber formed in the second rotary member from a communication inhibiting state to a communicating state.

6. A valve timing control apparatus comprising:

a first rotary member rotationally driven in synchronous with a crank shaft of an engine;

a second rotary member connected to a cam shaft so as to be rotationally driven;

an advance hydraulic chamber and a retard hydraulic chamber formed by utilizing the first rotary member and the second rotary member, and increasing or reducing a volumetric capacity by a relative rotational direction while working with a relative rotation of both the rotary members; and the valve timing control apparatus changing a rotational phase of the cam shaft by selectively supplying and discharging an oil from a hydraulic pressure supply and discharge means with respect to said advance hydraulic chamber and said retard hydraulic chamber so as to change an opening and closing timing of an intake valve or an exhaust valve, wherein a hole portion in an axial center position of the second rotary member is provided with a fluid rectifying apparatus having a control member generating an operating force at a specific phase angle of a variable torque of said cam shaft while working with said variable torque, operated by the operating force and controlling communication paths respectively provided in said advance hydraulic chamber and the retard hydraulic chamber arranged in the second rotary member from a communication inhibiting state to a communicating state.

7. An intake valve or opening and closing timing changing method by a valve timing control apparatus comprising:

a first rotary member rotationally driven in synchronous with a crank shaft of an engine;

a second rotary member connected to a cam shaft so as to be rotationally driven;

an advance hydraulic chamber and a retard hydraulic chamber formed by utilizing the first rotary member and the second rotary member, and increasing or reducing a volumetric capacity by a relative rotational direction while working with a relative rotation of both the rotary members; and the valve timing control apparatus changing a rotational phase of the cam shaft by selectively supplying and discharging an oil from a hydraulic pressure supply and discharge means with respect to said advance hydraulic chamber and said retard hydraulic chamber, wherein an operating force is generated at a phase angle near positive and negative maximum values of a variable torque while working with said variable torque of said cam shaft, and an opening and closing timing of the intake valve or the exhaust valve is changed by controlling said advance hydraulic chamber and the retard hydraulic chamber operated by the operating force and provided in the second rotary member from a communication inhibiting state to a communicating state.

8. An opening and closing timing changing method of an intake valve or an exhaust valve by a valve timing control apparatus as claimed in claim 7, wherein the method variably sets an operative region for controlling said advance hydraulic chamber and the retard hydraulic chamber from the communication inhibiting state to the communicating state and an inoperative region in which the control is not executed.

9. An intake valve or opening and closing timing changing method by a valve timing control apparatus comprising:

a first rotary member rotationally driven in synchronous with a crank shaft of an engine;

a second rotary member connected to a cam shaft so as to be rotationally driven;

an advance hydraulic chamber and a retard hydraulic chamber formed by utilizing the first rotary member and the second rotary member, and increasing or reducing a volumetric capacity by a relative rotational direction while working with a relative rotation of both the rotary members; and the valve timing control apparatus changing a rotational phase of the cam shaft by selectively supplying and discharging an oil from a hydraulic pressure supply and discharge means with respect to said advance hydraulic chamber and said retard hydraulic chamber, wherein an operating force is generated at a phase angle near positive and negative maximum values of a variable torque while working with said variable torque of said cam shaft, and an opening and closing timing of the intake valve or the exhaust valve is changed by controlling said advance hydraulic chamber and the retard hydraulic chamber operated by the operating force and provided in the second rotary member from a communication inhibiting state to a communicating state so as to move the pressure oil from said retard hydraulic chamber to said advance hydraulic chamber at a time of the phase angle near the negative maximum value, and/or move the pressure oil from said advance hydraulic chamber to said retard hydraulic chamber at the phase angle near the positive maximum value.

10. An opening and closing timing changing method of an intake valve or an exhaust valve by a valve timing control apparatus as claimed in claim 9, wherein the method variably sets an operative region for controlling said advance hydraulic chamber and the retard hydraulic chamber from the communication inhibiting state to the communicating state and an inoperative region in which the control is not executed.

* * * * *